United States Patent [19]

Cammarata

[11] 4,340,231

[45] Jul. 20, 1982

[54] RANDOM SELECTION WORD GAME

[76] Inventor: Joseph G. Cammarata, 90 Bartlett Ave., Arlington, Mass. 02174

[21] Appl. No.: 122,735

[22] Filed: Feb. 19, 1980

[51] Int. Cl.[3] ..... A63F 3/00

[52] U.S. Cl. ..... 273/243; 273/272

[58] Field of Search ..... 273/243, 248, 249, 256, 273/272, 274, 282

[56] References Cited

U.S. PATENT DOCUMENTS

| | | | |
|---|---|---|---|
| 2,995,374 | 8/1961 | Deatherage | 273/248 |
| 3,984,106 | 10/1976 | Whites | 273/243 |
| 4,055,347 | 10/1977 | Kreischer | 273/243 |
| 4,223,892 | 9/1980 | Matherne | 273/248 |

FOREIGN PATENT DOCUMENTS

| | | | |
|---|---|---|---|
| 552193 | 1/1958 | Canada | 273/272 |
| 1345245 | 1/1974 | United Kingdom | 273/243 |

*Primary Examiner*—Richard C. Pinkham
*Assistant Examiner*—Carl Moy
*Attorney, Agent, or Firm*—Joseph S. Iandiorio

[57] ABSTRACT

A word game utilizing random selection of predetermined letters including a game board having a plurality of sets of letters arranged in successive positions in a path from a start to a finish; each position including at least one letter; each set having a distinctive designation; means for marking selected positions along each path; and a die associated with each set and having on each of its faces the distinctive designation of its associated set; each die also containing on each face indicia representing an increment along the positions in a path for advancing the means for marking along each set of letters in correspondence with the indicia increment showing on the face of the die which bears the designation of that set for randomly choosing a plurality of letters from which to construct words.

10 Claims, 6 Drawing Figures

RANDOM SELECTION WORD GAME

FIELD OF INVENTION

This invention relates to a word game utilizing random selection of predetermined letters to form words; and more particularly to a word game in which the letters are variously weighted to provide a score for each word formed.

BACKGROUND AND SUMMARY OF INVENTION

There is provided a word game utilizing random selection of letters to be used to form words. The game is fun and entertaining, yet quite challenging and educational. Through a random selection process, a number of letters are made available to a player or team of players from which the greatest possible number of words is to be constructed. The game thus involves an understanding of letters, vowels and consonants, elements of spelling, and word formation. In addition, upon a challenge by an opponent, dictionary usage may be introduced to determine authenticity of a word formed which involves the additional skills of alphabetizing and acquaints the player with definitions of the words. In addition the requirement that the selected letters be written on a scoreboard on which the constructed words are also recorded exercises both the players' memory for letters and the players' penmanship. In many prior art word games victory goes to the older child or the adult with superior verbal skills. However in this game, in order to maintain the interest of all players, an element of chance is introduced in that each of the letters are given different numerical weights which are totalled for each word and then for all words constructed from letters chosen by a random selection.

The invention features a word game using random selection of predetermined letters. There is a game board having a plurality of sets of letters arranged in successive positions in a path from a start to a finish. Each of the positions includes at least one letter and each of the sets has a distinctive designation. There are means for marking selective positions along each path. There is a die associated with each set, and each die has on each of its faces the distinctive designation of its associated set. Further, each die also contains on each face indicia representing an increment along the positions of the path for advancing the means for marking along each set of letters in correspondence with the indicia increment showing on the face of the die which bears the designation of that set for randomly choosing the plurality of letters from which to construct words.

In a preferred embodiment the game includes a scoreboard having a column corresponding to each set and bearing the designation associated with each set. The scoreboard has a space for receiving each letter appearing at a selected position of the associated set and also has a plurality of rows associated with the columns for recording words constructed from the letters in each column.

The letters in each set may have a different numerical weight than those in other sets, and the scoreboard may include a representation of the numerical weight of each set at the column associated with that set. The scoreboard may also include an additional column for tallying the numerical value of each word constructed.

Typically there are four sets of letters and each position includes two letters, with twenty-six positions on each set. Typically, the four sets are designated 1, 2, 3, and 4, and the letters in each set have a numerical weight equal to the designations, i.e. 1, 2, 3, and 4. The means for marking may simply include a predetermined area proximate each position, and the area may include a hole for receiving a peg to mark the position of progress as the player moves along the set from start to finish. Thus the designation on each die includes one of the numbers 1, 2, 3, and 4, and whichever number is so designated is included on all of the faces of the die. Further, the indicia on the die would include the numbers 1, 2, 3, 4, 5, and 6, for example, representing from one to six incremental distances.

DISCLOSURE OF PREFERRED EMBODIMENT

Other objects, features and advantages will occur from the following description of a preferred embodiment and the accompanying drawings, in which.

Figure 1:
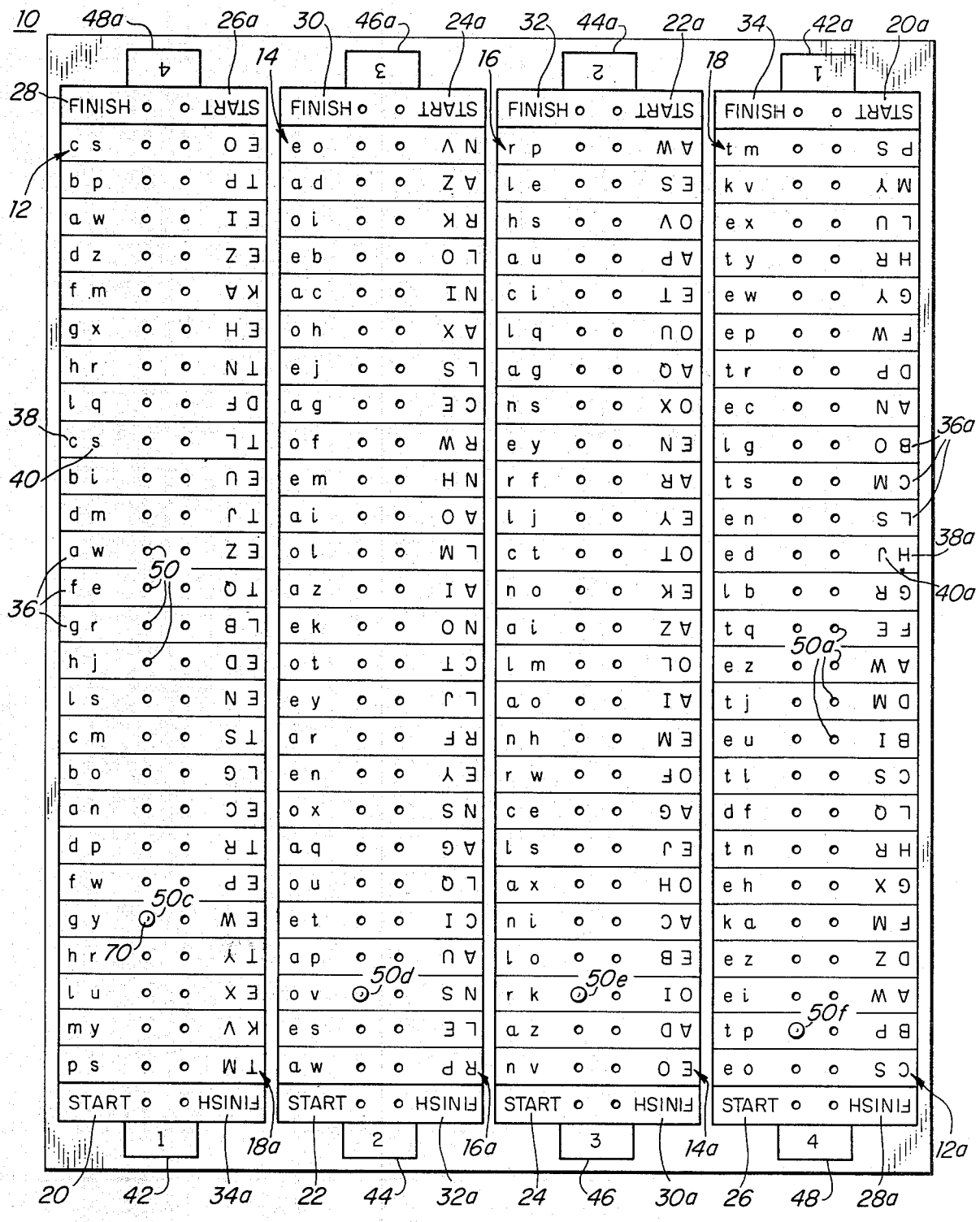
FIG. 1 is a plan view of a game board according to this invention.

The invention may be accomplished in a word game for random selection of predetermined letters, in which there is a game board having a plurality of sets of letters arranged in successive positions in a path from start to finish. For example, there may be any number of positions, and the paths may be circular, linear, or curvilinear from start to finish. Each position includes at least one letter, and each set of letters has associated with it a distinctive designation. For example the game board may have four sets of letters arranged in twenty-six positions with two letters at each position. The distinctive designation associated with each of the four sets may be simply the numbers 1, 2, 3, and 4, respectively.

There are some means for marking selected positions along each path. For example, there may be a designated space or a hole on which a player's piece or peg may be placed or inserted to indicate the currently selected position.

There is one die associated with each set, and the die associated with that set bears on each of its faces the distinctive designation of its associated set. That is, the die associated with set 1 would have a 1 on each of its six faces; that associated with set 2 would have a 2 on each of its six faces; and so on through the fourth die. In addition, each die also contains on each face some indicia representing an increment of movement along the positions in each path. For example, on each of the six faces of each die may be one of the additional numbers 1 through 6. Thus when the four dice have come to rest after a roll there is one die associated with each of the four sets and the face showing for each die has on it one of the numbers 1 through 6 showing the number of positions that the marking means, such as the piece or peg, is to be moved along that particular set in order that a plurality of letters, in this case two, from each set are randomly chosen from which that player is to construct words.

There is also a scoreboard which has a column corresponding to each set on the game board and bearing the same designation, e.g. the numbers 1, 2, 3, and 4 that are associated with that set on the game board. The scoreboard also includes a space to receive each letter which appears at a currently selected position on the game board, and there are a plurality of rows associated with the columns for recording words constructed from the letters in each column. The letters in each set have a different numerical weight than those in the other sets. For example, on the game board, the two letters selected from column 1 are worth one point each; the two letters from column 2 two points each; the two letters from column 3 three points each; and the two letters from column 4 four points each. The object of the game is to get the highest score possible by forming as many words as possible with letters having the highest values possible. Typically there is an additional column for tallying the numerical value of each word constructed, and there may in fact be a position for totalling all of the numerical values for each of the words constructed to give a total numerical score.

There is shown in FIG. 1 a game board 10 having four sets of letters 12, 14, 16, 18, arranged in a straight path from START 20, 22, 24, 26, to their FINISH, 28, 30, 32, 34. Each set includes twenty-six positions 36 as shown with respect to set 12, and in each position there are two letters 38 and 40. Each set has associated with it a distinctive designation, for example set 12 has a designation 1 at 42; set 14 has the designation 2 at 44; set 16 a designation 3 at 46; and set 18 a designation 4 at 48. There are means for marking the selected positions along each path. For example, the circular spaces 50 mark the positions along set 12.

As illustrated in FIG. 1, there may be a second group of four sets of letters, indicated by like drawing reference numbers accompanied by a lower case a, which extend in the opposite direction of the first group in order to enable two players or teams of players to simultaneously oppose each other.

Figure 2:
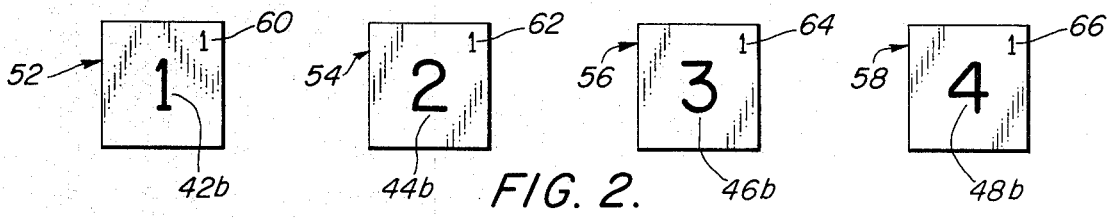
FIG. 2 is a plan view of a set of four dice according to this invention.
Figure 5:
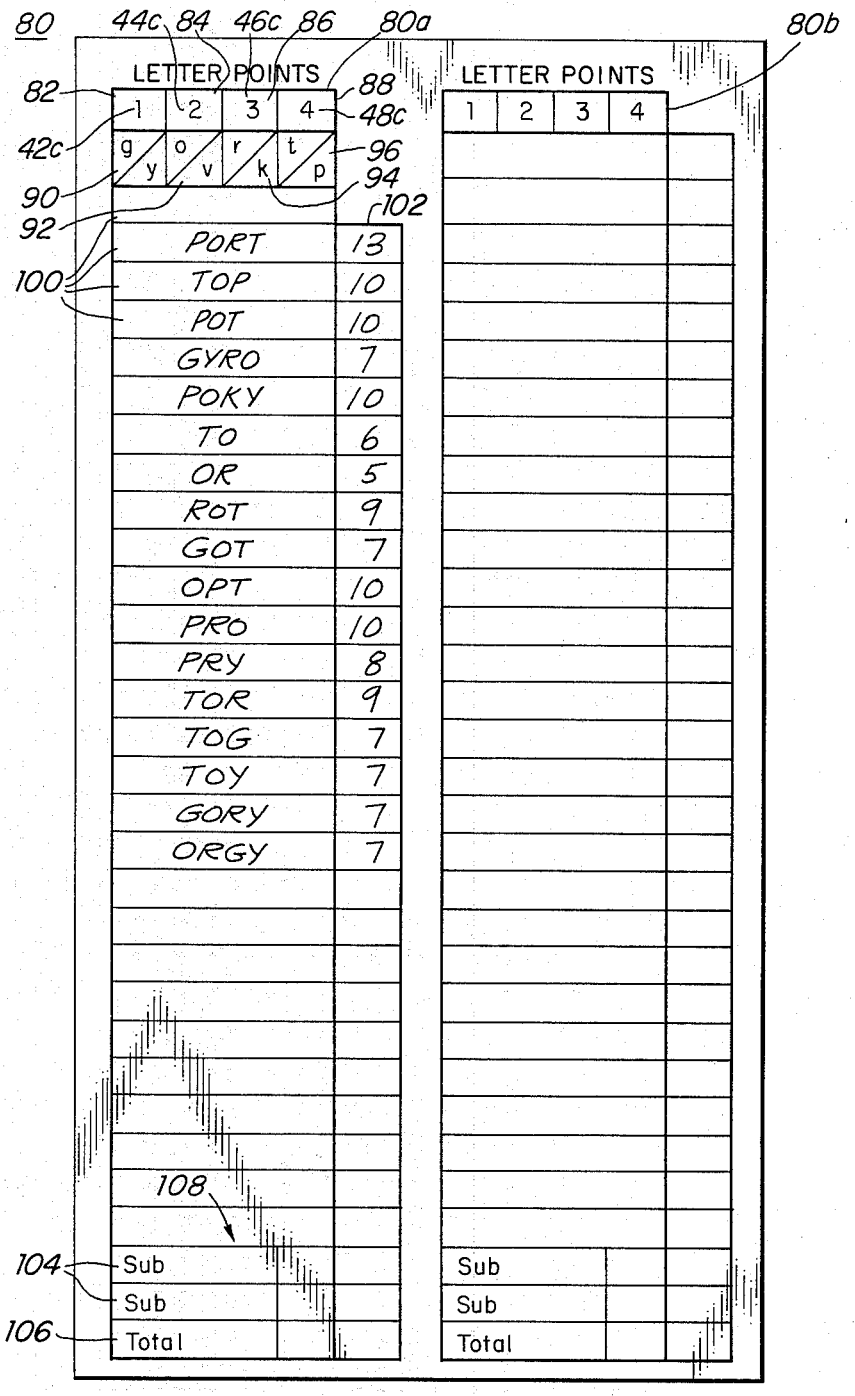
FIG. 5 is a scoreboard according to this invention.
Figure 3:
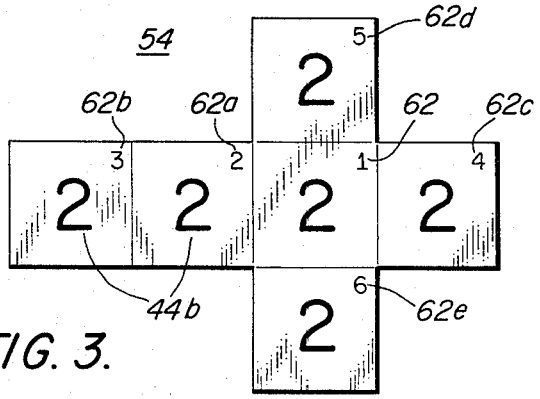
FIG. 3 is an illustrative view showing one die with all six of its faces in one plane.

Associated with the game board 10 of FIG. 1 are four dice 52, 54, 56, and 58, FIG. 2. Each die has on each of its six faces the distinctive designation of its associated set. For example, die 52 has on each of its six faces the designation 1, 42*b;* die 54 has on each of its six faces the designation 2, 44*b;* die 56 has on each of its six faces designation 3, 47*b;* and die 58 has on each of its faces designation 4, 48*b;* each of which corresponds respectively to the designations associated with the sets 12, 14, 16, and 18 shown in FIG. 1 as well as with the sets 12*a*, 14*a*, 16*a*, and 18*a*. In addition, each die includes on each of its faces a different indicia, e.g. a different one of the numbers 1 through 6. In FIG. 2 the indicia on die 52 is the number 1, as are the indicia 62, 64, and 66 on dice 54, 56, and 58 respectively, since in FIG. 2 the same face of each die is shown. However, each face of each die contains a different one of the indicia, e.g. the numbers 1 through 6, as shown in FIG. 3 where die 54, which bears the designation 2, 44*b*, on each of its six faces, also contains on each of its six faces a different one of the indicia representing an increment of movement along the positions in a path, e.g. the numbers 1 through 6 as shown in FIG. 3: 1, 62; 2, 62*a;* 3, 62*b;* 4, 62*c;*5, 62*d;* and 6, 62*e*.

Figure 4:
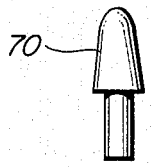
FIG. 4 is an elevational view of a peg which may be used with the game board of FIG. 1.

The means for marking selected positions along the path such as at spaces 50 may be a piece which sits on the space associated with the selected position, or may be a peg 70, FIG. 4, which actually fits in a hole at the space 50.

There is also included a scoreboard 80 including a column 82, 84, 86, 88, associated with each of the four sets and typically bearing the designation, e.g. the numbers 1, 2, 3, and 4, associated with that set. There is also a space 90, 92, 94, and 96 for receiving each letter appearing at a selected position of the associated set on the game board 10. In this case each of spaces 90, 92, 94, and 96 is divided into two parts by a diagonal line because each position includes two letters 38 and 40. Each player or team of players uses its own scoreboard 80 having one or more columns 80a, 80b.

There are also a plurality of rows 100 associated with the columns for recording words constructed from the letters in the spaces 90, 92, 94, and 96 associated with each column. An additional column 102 is provided for tallying the individual numerical score for each constructed word in accordance with the numerical value assigned to each of the letters in the word, which in this case is one and the same, with the designations 1, 2, 3, and 4, 42*c*, 44*c*, 46*c*, and 48*c*. Spaces 108 record the subtotals and totals of the number of words formed in that column. Spaces 104 and 106 may be provided at the bottom of scoreboard 80 to record the subtotals and totals of the numerical scores of all the words formed.

Figure 6:
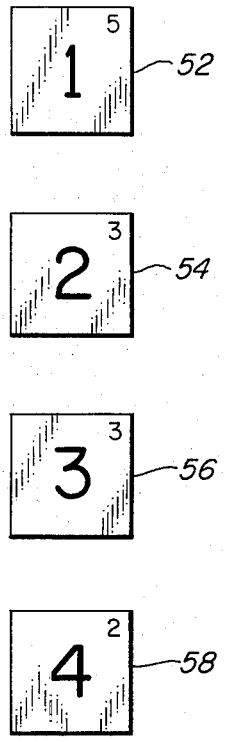
FIG. 6 is a plan view of a set of four dice after a toss of the dice.

In operation, after a player rolls the dice and they come to rest, each die indicates the selected position in each set. For example, the dice come to rest with the faces showing as in FIG. 6, where die 52 indicates that for set 1 the fifth position, 50*c*, is selected; die 54 indicates that for set 2 the third position, 50*d*, is selected; die 56 indicates that for the third set the position 3, 50*e*, is selected; and for the fourth set, die 58 indicates that the second position, 50*f*, is selected.

Thus the letters GY are recorded in space 90, the letters OV in space 92, the letters RK in space 94, and the letters TP in space 96. The player then makes as many words as he or she can using those letters in any combination to attain the highest numerical value in order to accumulate the highest overall score. As shown, these words include "port" which has a value of 13 (O=2; R=3; T=4; P=4); "top" which has a value of 10 (T=4; O=2; P=4); and so on. Simultaneously, the second player may be recording his score on his own scoreboard 80. When a player has constructed all the words that he possibly can from the letters selected upon one roll of the dice, he rolls the dice again and moves his piece or peg as indicated by the dice and once again attempts to construct as many words as possible with the newly selected letters. The game is over when a player has moved off the board and no words can be formed with the remaining letter or letters. At that point all players' scores are tallied and the winner is determined. The designations and indicia of course need not be numbers; they can be letters or any other form of indicia or designations desired. If the designations are not numbers or if the numbers of the designations are not desirable numerical weightings for the letters, then other numerical weightings may be used.

Other embodiments will occur to those skilled in the art and are within the following claims:

What is claimed is:

1. A word game utilizing random selection of predetermined letters comprising:

a game board having a plurality of sets of letters arranged in successive positions in a path from a start to a finish; each position including at least one letter; each set having a distinctive designation;

means for marking selected positions along each path;

a die associated with each set and having on each of its faces the distinctive designation of its associated set; each die also containing on each face indicia representing an increment along the positions in a path for advancing said means for marking along each set of letters in correspondence with the indicia increment showing on the face of the die which bears the designation of that set for randomly choosing a plurality of letters from which to construct words; and a scoreboard having a column corresponding to each set and bearing the designation associated with that set, having a space for receiving each letter appearing at a selected position of the associated set, and having a plurality of rows associated with the columns for recording words constructed from the letters in each column; the letters in each set having a different numerical weight than those in other sets; and the scoreboard including a representation of the numerical weight of each set at the column associated with that set.

2. The game of claim 1 in which the scoreboard includes an additional column for tallying the numerical value of each word constructed.

3. The game of claim 1 in which there are four sets of letters and each position includes two letters.

4. The game of claim 1 in which there are twenty-six positions in each set.

5. The game of claim 4 in which the four sets are designated 1, 2, 3, and 4.

6. The game of claim 5 in which the letters in each set have a numerical weight equal to their designation.

7. The game of claim 1 in which said means for marking includes a predetermined area proximate each position.

8. The game of claim 7 in which said area includes a hole and said means for marking further includes a peg for insertion in a said hole.

9. The game of claim 1 in which the designation on each die includes one of said numbers 1, 2, 3, and 4 on all its faces.

10. The game of claim 9 in which the indicia on each die includes the numbers 1, 2, 3, 4, 5, and 6.

* * * * *